US009651259B2

(12) United States Patent
Boardman et al.

(10) Patent No.: US 9,651,259 B2
(45) Date of Patent: May 16, 2017

(54) MULTI-INJECTOR MICROMIXING SYSTEM

(71) Applicant: General Electric Company, Schenectady, NY (US)

(72) Inventors: Gregory Allen Boardman, Greer, SC (US); Patrick Benedict Melton, Horse Shoe, NC (US); James Harold Westmoreland, Greer, SC (US)

(73) Assignee: General Electric Company, Schenectady, NY (US)

( * ) Notice: Subject to any disclaimer, the term of this patent is extended or adjusted under 35 U.S.C. 154(b) by 1004 days.

(21) Appl. No.: 13/797,859

(22) Filed: Mar. 12, 2013

(65) Prior Publication Data

US 2014/0283522 A1 Sep. 25, 2014

(51) Int. Cl.
*F23R 3/28* (2006.01)

(52) U.S. Cl.
CPC ..... *F23R 3/286* (2013.01)

(58) Field of Classification Search
CPC .... F23R 3/045; F23R 3/10; F23R 3/20; F23R 3/26; F23R 3/283; F23R 3/286; F23R 3/30; F23R 3/32; F23R 2900/03044
See application file for complete search history.

(56) References Cited

U.S. PATENT DOCUMENTS 1,855,165 A 4/1932 Barker
2,564,042 A 8/1951 Walker
3,581,492 A 6/1971 Norgren et al.
3,751,911 A 8/1973 De Tartaglia
4,100,733 A 7/1978 Striebel et al.
4,408,461 A 10/1983 Bruhwiler et al.
4,587,809 A 5/1986 Ohmori et al.
4,763,481 A 8/1988 Cannon
4,796,429 A 1/1989 Verdouw
5,121,597 A 6/1992 Urushidani et al.
5,161,366 A 11/1992 Beebe
5,235,814 A 8/1993 Leonard
5,274,991 A 1/1994 Fitts
5,361,586 A 11/1994 McWhirter et al.
5,410,884 A 5/1995 Fukue et al.
5,415,000 A 5/1995 Mumford et al.
5,515,680 A 5/1996 Fujimura et al.
5,611,196 A 3/1997 Wilson
5,675,971 A 10/1997 Angel et al.
5,778,676 A 7/1998 Joshi et al.
5,816,049 A 10/1998 Joshi
(Continued)

OTHER PUBLICATIONS

U.S. Appl. No. 13/797,848, filed Mar. 12, 2013, Boardman et al.
(Continued)

*Primary Examiner* — Arun Goyal
(74) *Attorney, Agent, or Firm* — Fletcher Yoder, P.C.

(57) ABSTRACT

Embodiments of the present disclosure are directed to a system having components for premixing fuel and air prior to combustion within a combustion chamber. The system includes a plurality of mixing tubes configured to receive and to mix fuel and air. Each mixing tube is paired with a fuel injector, and the fuel injector is positioned axially within a portion of the mixing tube. Fuel is injected from the fuel injector into the respective mixing tube, and air flows radially into each mixing tube through one or more apertures formed on the mixing tube. The fuel and air are mixed within the mixing tube and are deposited into a combustion chamber for combustion.

19 Claims, 9 Drawing Sheets

(56) References Cited

U.S. PATENT DOCUMENTS 5,822,992 A 10/1998 Dean
5,901,555 A 5/1999 Mandai et al.
5,927,076 A 7/1999 Pillsbury
5,943,866 A 8/1999 Lovett et al.
6,016,658 A 1/2000 Willis et al.
6,026,645 A 2/2000 Stokes et al.
6,038,861 A 3/2000 Amos et al.
6,092,363 A 7/2000 Ryan
6,164,055 A 12/2000 Lovett et al.
6,334,309 B1 1/2002 Dean et al.
6,351,948 B1 3/2002 Goeddeke
6,360,776 B1 3/2002 McCormick et al.
6,363,724 B1 4/2002 Bechtel et al.
6,438,959 B1 8/2002 Dean et al.
6,438,961 B2 8/2002 Tuthill et al.
6,530,222 B2 3/2003 Stuttaford et al.
6,532,742 B2 3/2003 Scarinci et al.
6,705,087 B1 3/2004 Ohri et al.
6,832,483 B2 12/2004 Moriya et al.
6,880,340 B2 4/2005 Saitoh
6,928,823 B2 8/2005 Inoue et al.
6,983,600 B1 1/2006 Dinu et al.
7,007,478 B2 3/2006 Dinu
7,007,486 B2 3/2006 Sprouse et al.
7,021,562 B2 4/2006 Mansour et al.
7,134,287 B2 11/2006 Belsom et al.
7,171,813 B2 2/2007 Tanaka et al.
7,181,916 B2 2/2007 Ziminsky et al.
7,284,378 B2 10/2007 Amond, III et al.
7,469,544 B2 12/2008 Farhangi
7,578,130 B1 8/2009 Kraemer et al.
7,617,682 B2 11/2009 Bruck
7,841,180 B2 11/2010 Kraemer et al.
7,841,182 B2 11/2010 Martin
7,900,456 B2 3/2011 Mao
8,042,339 B2 10/2011 Lacy et al.
8,065,880 B2 11/2011 Ishizaka et al.
8,079,218 B2 12/2011 Widener
8,104,291 B2 1/2012 Myers et al.
8,122,721 B2 2/2012 Johnson et al.
8,205,452 B2 6/2012 Boardman et al.
8,234,871 B2 8/2012 Davis, Jr. et al.
8,234,872 B2 8/2012 Berry et al.
8,240,151 B2 8/2012 Pelletier et al.
8,266,912 B2 9/2012 Berry et al.
8,276,385 B2 10/2012 Zuo et al.
8,322,143 B2 12/2012 Uhm et al.
8,327,642 B2 12/2012 Uhm et al.
8,402,763 B2 3/2013 Mulherin et al.
8,408,004 B2 4/2013 Davis, Jr. et al.
8,424,311 B2 4/2013 York et al.
8,438,853 B2 5/2013 Green et al.
8,474,265 B2 7/2013 Jain et al.
8,484,978 B2 7/2013 Bailey et al.
8,505,304 B2 8/2013 Myers et al.
8,522,555 B2 9/2013 Berry et al.
8,528,334 B2 9/2013 Dutta et al.
8,528,336 B2 9/2013 Cihlar et al.
8,528,839 B2 9/2013 Bailey et al.
8,572,979 B2 11/2013 Smith et al.
8,616,002 B2 12/2013 Kraemer et al.
8,701,419 B2 4/2014 Hughes
8,789,372 B2 7/2014 Johnson et al.
8,800,289 B2 8/2014 Johnson et al.
8,850,821 B2 10/2014 Khan et al.
8,899,049 B2 12/2014 Krull et al.
8,904,797 B2 12/2014 Berry et al.
8,919,127 B2 12/2014 Melton et al.
8,938,978 B2 1/2015 Bailey et al.
9,032,704 B2 5/2015 Crothers et al.
9,163,839 B2 10/2015 Westmoreland et al.
9,200,571 B2 12/2015 Bailey et al.
9,255,711 B2 2/2016 Crothers et al.
9,316,397 B2 4/2016 Stewart et al.
2001/0052229 A1 12/2001 Tuthill et al.
2002/0014078 A1 2/2002 Mandai et al.
2002/0119412 A1 8/2002 Loving
2002/0128790 A1 9/2002 Woodmansee
2002/0192615 A1 12/2002 Moriya et al.
2003/0014975 A1 1/2003 Nishida et al.
2003/0037549 A1 2/2003 Mandai et al.
2003/0089801 A1 5/2003 Saitoh et al.
2004/0006990 A1 1/2004 Stuttaford et al.
2004/0006991 A1 1/2004 Stuttaford et al.
2004/0006992 A1 1/2004 Stuttaford et al.
2004/0006993 A1 1/2004 Stuttaford et al.
2004/0060297 A1 4/2004 Koenig et al.
2004/0142294 A1 7/2004 Niass et al.
2004/0163392 A1 8/2004 Nishida et al.
2007/0289305 A1 12/2007 Oda et al.
2008/0053097 A1 3/2008 Han et al.
2008/0078179 A1 4/2008 Cai
2008/0163627 A1 7/2008 ELKady et al.
2009/0229269 A1 9/2009 Lacy et al.
2009/0241547 A1 10/2009 Luts et al.
2009/0280443 A1 11/2009 Carroni et al.
2010/0064691 A1 3/2010 Laster et al.
2010/0089065 A1 4/2010 Tuthill
2010/0192579 A1 8/2010 Boardman et al.
2010/0192583 A1 8/2010 Cano Wolff et al.
2010/0192586 A1 8/2010 Terada et al.
2010/0205970 A1 8/2010 Hessler et al.
2010/0218501 A1 9/2010 York et al.
2010/0236252 A1 9/2010 Huth
2010/0263384 A1 10/2010 Chila
2011/0005230 A1 1/2011 Bailey et al.
2011/0016866 A1 1/2011 Boardman et al.
2011/0016871 A1 1/2011 Kraemer et al.
2011/0107764 A1 5/2011 Bailey et al.
2011/0113783 A1 5/2011 Boardman et al.
2011/0197591 A1 8/2011 Valeev et al.
2011/0209481 A1 9/2011 Simmons
2011/0314823 A1 12/2011 Smith et al.
2012/0047902 A1 3/2012 Tuthill
2012/0055167 A1 3/2012 Johnson et al.
2012/0073302 A1 3/2012 Myers et al.
2012/0180487 A1 7/2012 Uhm et al.
2012/0180488 A1 7/2012 Bailey et al.
2012/0227371 A1 9/2012 Johnson et al.
2012/0324896 A1 12/2012 Kim et al.
2013/0025285 A1 1/2013 Stewart et al.
2013/0067920 A1 3/2013 Fox et al.
2013/0074503 A1 3/2013 Rohrssen et al.
2013/0086912 A1 4/2013 Berry
2013/0104554 A1 5/2013 Bode et al.
2013/0125549 A1 5/2013 Bailey et al.
2013/0180256 A1 7/2013 Stoia
2013/0213051 A1 8/2013 Westmoreland, III et al.
2013/0232977 A1 9/2013 Siddagangaiah et al.
2013/0232979 A1 9/2013 Singh
2013/0299602 A1 11/2013 Hughes et al.
2014/0033718 A1 2/2014 Manoharan et al.
2014/0033722 A1 2/2014 Abdel-Hafez et al.
2014/0109587 A1 4/2014 Crothers et al.
2014/0245738 A1 9/2014 Crothers et al.
2014/0260259 A1 9/2014 Ginesin et al.
2014/0260267 A1 9/2014 Melton et al.
2014/0260268 A1 9/2014 Westmoreland et al.
2014/0260271 A1 9/2014 Keener et al.
2014/0260276 A1 9/2014 Westmoreland et al.
2014/0260299 A1 9/2014 Boardman et al.
2014/0260300 A1 9/2014 Chila et al.
2014/0260315 A1 9/2014 Westmoreland et al.
2014/0283522 A1 9/2014 Boardman et al.
2014/0338338 A1 11/2014 Chila et al.
2014/0338339 A1 11/2014 Westmoreland et al.
2014/0338340 A1 11/2014 Melton et al.
2014/0338344 A1 11/2014 Stewart et al.
2014/0338354 A1 11/2014 Stewart et al.
2014/0338356 A1 11/2014 Keener et al.
2014/0367495 A1 12/2014 Monaghan et al.
2015/0000285 A1 1/2015 Deiss et al.
2015/0059353 A1 3/2015 Asai et al.

(56) References Cited

U.S. PATENT DOCUMENTS

| | | | |
|---|---|---|---|
| 2015/0165568 | A1 | 6/2015 | Means et al. |
| 2016/0040883 | A1 | 2/2016 | Asai et al. |
| 2016/0060154 | A1 | 3/2016 | Cowles et al. |

OTHER PUBLICATIONS

U.S. Appl. No. 13/797,883, filed Mar. 12, 2013, Melton et al.
U.S. Appl. No. 13/797,896, filed Mar. 12, 2013, Westmoreland et al.
U.S. Appl. No. 13/797,912, filed Mar. 12, 2013, Chila et al.
U.S. Appl. No. 13/797,925, filed Mar. 12, 2013, Westmoreland et al.
U.S. Appl. No. 13/797,961, filed Mar. 12, 2013, Westmoreland et al.
U.S. Appl. No. 13/797,986, filed Mar. 12, 2013, Chila et al.
U.S. Appl. No. 13/798,012, filed Mar. 12, 2013, Melton et al.
U.S. Appl. No. 13/798,027, filed Mar. 12, 2013, Westmoreland et al.
U.S. Appl. No. 13/400,248, filed Feb. 20, 2012, Westmoreland et al.
U.S. Appl. No. 13/705,443, filed Dec. 5, 2012, Belsom et al.

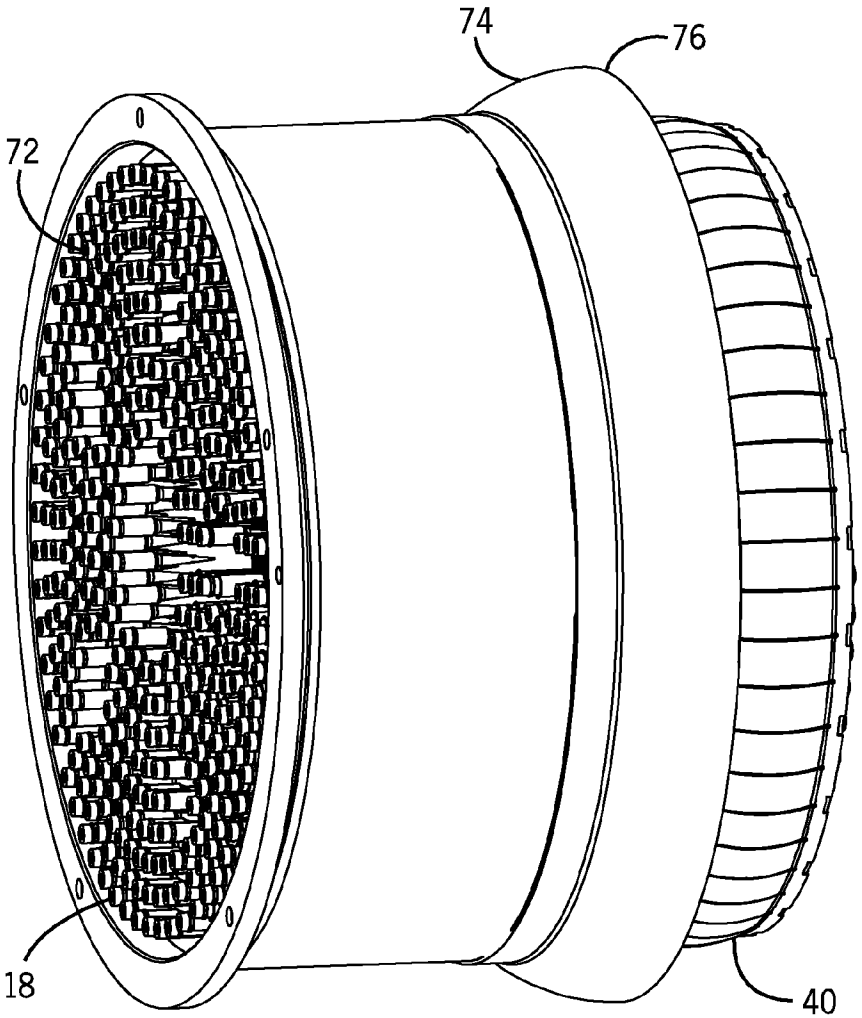
FIG. 7
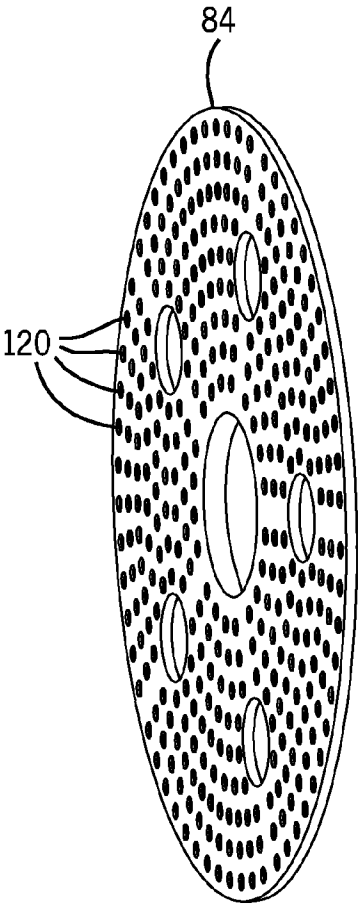

MULTI-INJECTOR MICROMIXING SYSTEM

BACKGROUND

The subject matter disclosed herein relates generally to turbine combustors, and, more particularly to premixing turbine combustors.

Gas turbine systems generally include a compressor, a combustor, and a turbine. The compressor compresses air from an air intake, and subsequently directs the compressed air to the combustor. In the combustor, the compressed air received from the compressor is mixed with a fuel and is combusted to create combustion gases. The combustion gases are directed into the turbine. In the turbine, the combustion gases pass across turbine blades of the turbine, thereby driving the turbine blades, and a shaft to which the turbine blades are attached, into rotation. The rotation of the shaft may further drive a load, such as an electrical generator, that is coupled to the shaft. Conventional gas turbine systems can be expensive to manufacture and can be difficult to repair. Thus, there remains a need for a gas turbine system that is less costly to manufacture and/or that allows for easier repair, in addition to providing for efficient combustion.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a premixing system for a gas turbine engine includes a plurality of mixing tubes. Each mixing tube includes a wall defining a chamber within the mixing tube, wherein the chamber extends between a first end and a second end of the mixing tube. Each mixing tube has one or more apertures formed in the wall of the mixing tube, and the apertures are configured to receive an air flow. Additionally, each mixing tube has a fuel intake portion configured to receive a fuel flow from a fuel injector that is positioned axially within the first end of the mixing tube. Each mixing tube also has a fuel-air mixture outlet positioned at the second end of the mixing tube.

In a second embodiment, a gas turbine system includes a combustor having a combustion chamber. The combustor has a plurality of mixing tubes, wherein each mixing tube is configured to receive fuel and air and to deposit a fuel-air mixture into the combustion chamber. The air is received radially into a mixing chamber of each mixing tube through a plurality of apertures formed in each mixing tube. The combustor also includes a plurality of fuel injectors, wherein each fuel injector is axially positioned within a respective mixing tube, and wherein each fuel injector is configured to inject fuel axially and/or radially into the mixing chamber of the respective mixing tube.

In a third embodiment, a method includes injecting fuel into a mixing chamber of a mixing tube through a plurality of holes in a wall of a fuel injector, wherein the fuel injector is axially positioned within a portion of the mixing tube. The method also includes flowing air from an air cavity in a head end of a combustor into the mixing chamber of the mixing tube through one or more apertures in the wall of the mixing tube, mixing the air and fuel within the mixing chamber of the mixing tube to create a fuel-air mixture, and depositing the fuel-air mixture from the mixing chamber into a combustion chamber.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 7 is a perspective view of an embodiment of a portion of the turbine combustor, illustrating a step in an assembly process of the gas turbine system;

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Gas turbine engines may include components for premixing fuel and air prior to combustion within a combustion chamber. The disclosed embodiments are directed towards a fuel and air premixing system having a plurality of mixing tubes (e.g., 10 to 1000 mixing tubes), wherein each mixing tube is paired with a fuel injector. In certain embodiments, each mixing tube may have a diameter of less than approximately 1, 2, 3, 4, or 5 centimeters. For example, each mixing tube may have a diameter between approximately 0.5 to 2, 0.75 to 1.75, or 1 to 1.5 centimeters. In certain embodiments, the fuel injector injects fuel axially into the mixing tube, while pressurized air is transferred radially into the mixing tube. The presently described system may provide lower manufacturing costs, easier repair procedures, flexibility with respect to fuel, substantially uniform air and fuel distribution, and/or low emissions, for example.

Figure 1:
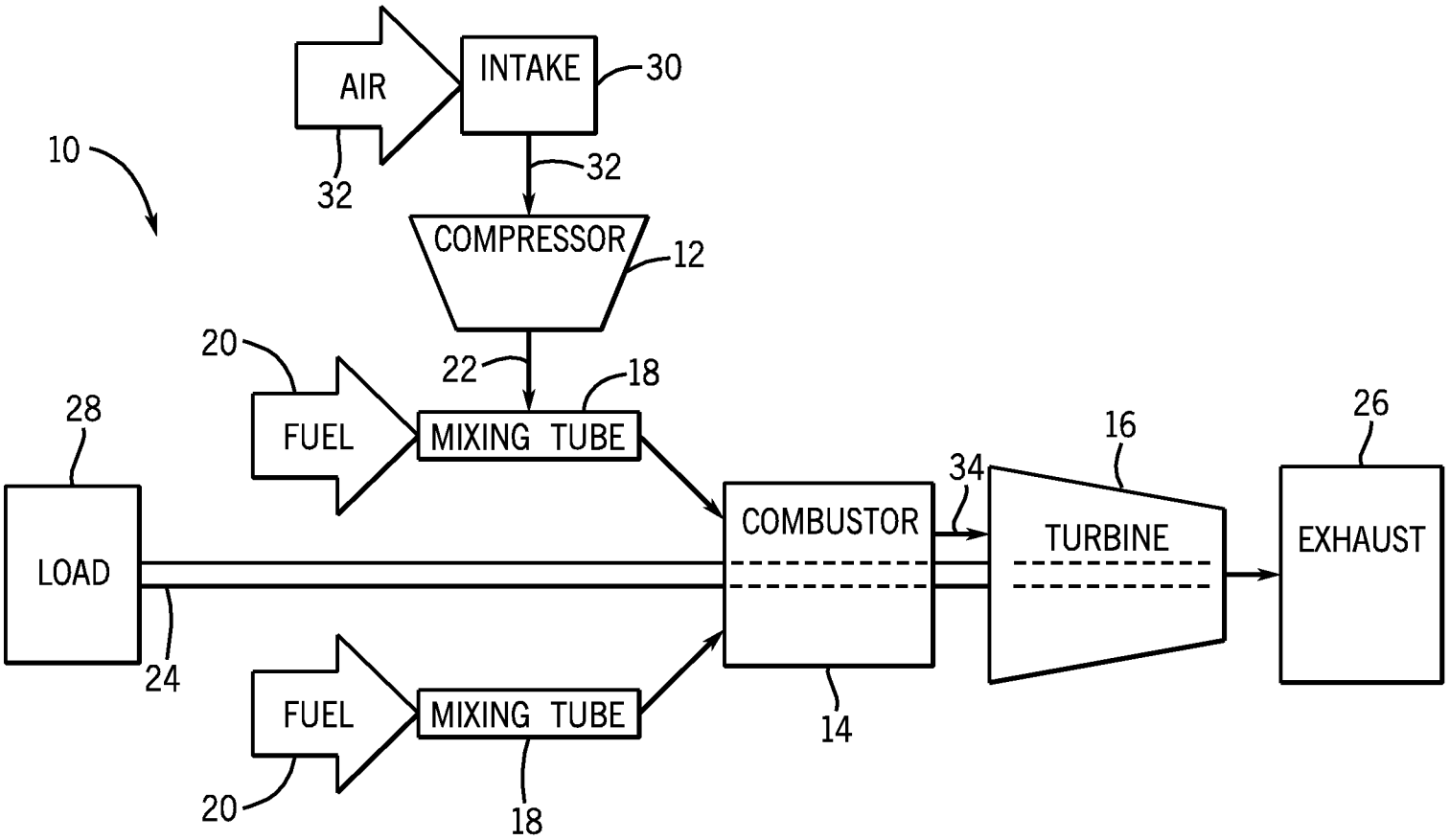
FIG. 1 is a schematic of an embodiment of a gas turbine system with a plurality of mixing tubes.

Turning to the drawings, FIG. 1 illustrates a block diagram of an embodiment of a gas turbine system 10. As shown, the system 10 includes a compressor 12, a turbine combustor 14, and a turbine 16. The turbine combustor 14 may include one or more mixing tubes 18 (e.g., 10 to 1000 mixing tubes) configured to receive both fuel 20 and pressurized oxidant 22, such as air, oxygen, oxygen-enriched air, oxygen reduced air, or any combination thereof. Although the following discussion refers to air as the oxidant 22, any suitable oxidant may be used with the disclosed embodiments. Again, the mixing tubes may be described as micromixing tubes, which may have diameters between approximately 0.5 to 2, 0.75 to 1.75, or 1 to 1.5 centimeters. The mixing tubes 18 may be arranged in one or more bundles of closely spaced tubes, generally in a parallel arrangement relative to one another. In this configuration, each mixing tube 18 is configured to mix (e.g., micromix) on a relatively small scale within each mixing tube 18, which ten outputs a fuel-air mixture into the combustion chamber. In certain embodiments, the system 10 may use a liquid fuel and/or gas fuel 20, such as natural gas or syngas.

Compressor blades are included as components of the compressor 12. The blades within the compressor 12 are coupled to a shaft 24, and will rotate as the shaft 24 is driven to rotate by the turbine 16, as described below. The rotation of the blades within the compressor 12 compresses air 32 from an air intake 30 into pressurized air 22. The pressurized air 22 is then fed into the mixing tubes 18 of the turbine combustors 14. The pressurized air 22 and fuel 20 are mixed within the mixing tubes 18 to produce a suitable fuel-air mixture ratio for combustion (e.g., a combustion that causes the fuel to more completely burn so as not to waste fuel 20 or cause excess emissions).

The turbine combustors 14 ignite and combust the fuel-air mixture, and then pass hot pressurized combustion gasses 34 (e.g., exhaust) into the turbine 16. Turbine blades are coupled to the shaft 24, which is also coupled to several other components throughout the turbine system 10. As the combustion gases 34 flow against and between the turbine blades in the turbine 16, the turbine 16 is driven into rotation, which causes the shaft 24 to rotate. Eventually, the combustion gases 34 exit the turbine system 10 via an exhaust outlet 26. Further, the shaft 24 may be coupled to a load 28, which is powered via rotation of the shaft 24. For example, the load 28 may be any suitable device that may generate power via the rotational output of the turbine system 10, such as an electrical generator, a propeller of an airplane, and so forth.

Figure 2:
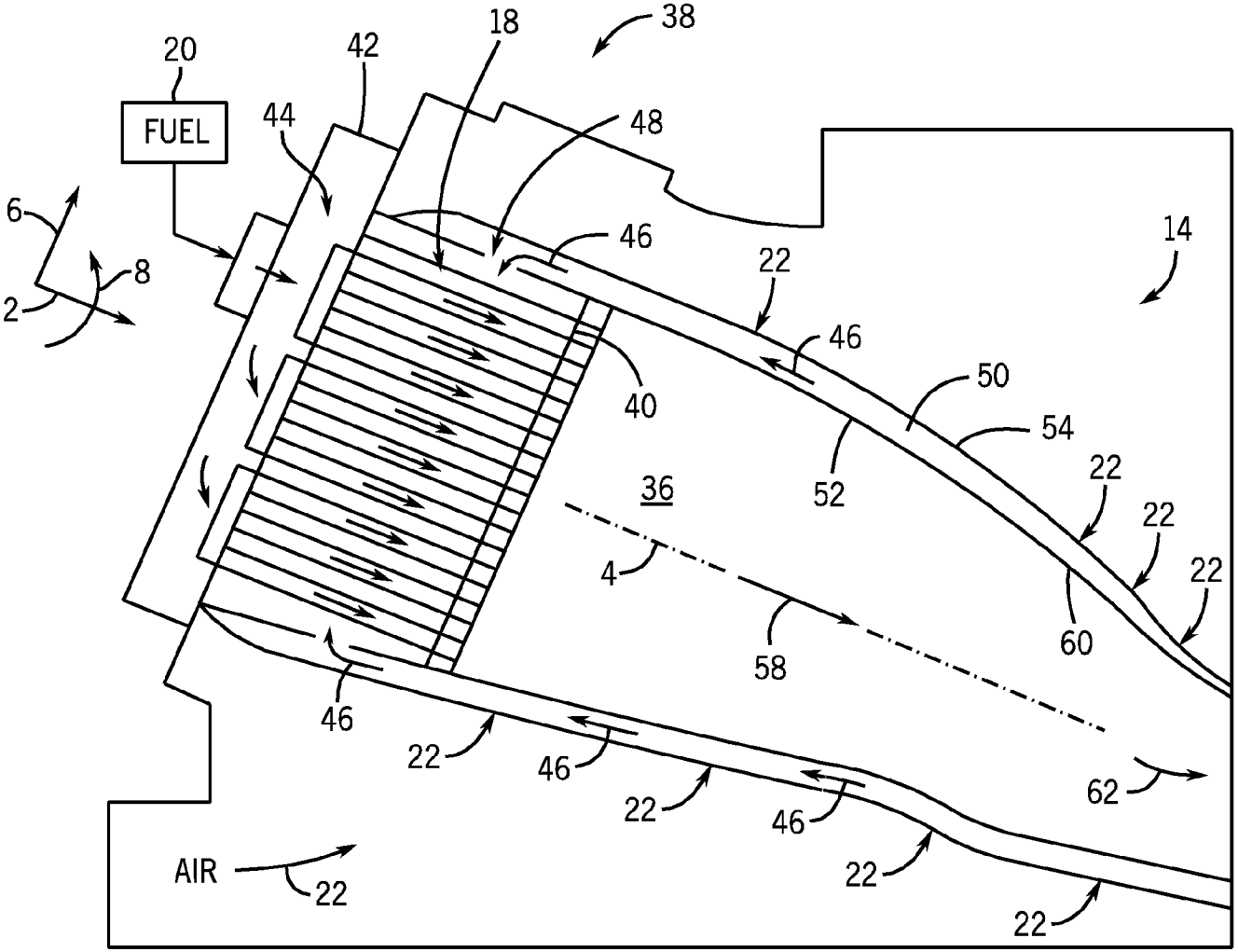
FIG. 2 is a cross-sectional side view schematic of an embodiment of a turbine combustor, illustrating an embodiment of the plurality of mixing tubes positioned within a head end of the combustor.

FIG. 2 is a cross-sectional schematic of an embodiment of the combustor 14 of FIG. 1. As shown, the combustor 14 includes a combustion chamber 36 and a head end 38. A plurality of mixing tubes 18 are positioned within the head end 38 of the combustor 14, and the mixing tubes 18 may generally extend between a cap 40 and an end cover 42. In some embodiments, the mixing tubes 18 are suspended in the head end 38, such that the mixing tubes 18 are not attached to the end cover 42 or the cap 40. Alternatively, however, the mixing tubes 18 may be coupled to at least one of the cap 40 or the end cover 42, as further described below. The end cover 42 may also include a fuel plenum 44 for providing fuel to the mixing tubes 18. In the following discussion, reference may be made to an axial direction 2, along an axis 4 of the combustor 14, a radial direction 6 away from or toward the axis 4, and a circumferential direction 8 around the axis 4. The mixing tubes 18 extend in the axial direction 2 and are generally parallel to one another. The fuel plenum 44 routes fuel to the mixing tubes 18 in the axial direction 2 whereas the mixing tubes 18 receive air in the radial direction 6.

As described above, the compressor 12 receives air 32 from the air intake 30, compresses the air 32, and produces the flow of pressurized air 22 for use in the combustion process. As shown by arrow 46, the pressurized air 22 is provided to the head end 38 of the combustor 14 through an air inlet 48, which directs the air laterally or radially 6 towards side walls of the mixing tubes 18. More specifically, the pressurized air 22 flows in the axial direction 2 indicated by arrow 46 from the compressor 12 through an annulus 50 between a liner 52 and a flow sleeve 54 of the combustor 14 to reach the head end 38. The liner 52 is positioned circumferentially about combustion chamber 36, the annulus 50 is positioned circumferentially about liner 52, and the flow sleeve 54 is positioned circumferentially about annulus 50. Upon reaching the head end 38, the air 22 turns from the axial direction 2 to the radial direction 6 through the inlet 48 toward the mixing tubes 18, as indicated by arrows 46.

The pressurized air 22 is mixed with the fuel 20 within the plurality of mixing tubes 18. As discussed below, each mixing tube 18 received the fuel 20 in the axial direction 2 through an axial end portion of the mixing tube 18, while also receiving the air 22 through a plurality of side openings in the mixing tube 18. Thus, the fuel 20 and the air 22 mix within each individual mixing tube 18. As shown by arrows 56, the fuel-air mixture flows downstream within the mixing tubes 18 into the combustion chamber 36 where the fuel-air mixture is ignited and combusted to form the combustion gases 34 (e.g., exhaust). The combustion gases 34 flow in a direction 58 toward a transition piece 60 of the turbine combustor 14. The combustion gases 34 pass through the transition piece 60, as indicated by arrow 62, toward the turbine 16, where the combustion gases 34 drive the rotation of the blades within the turbine 16.

Figure 3:
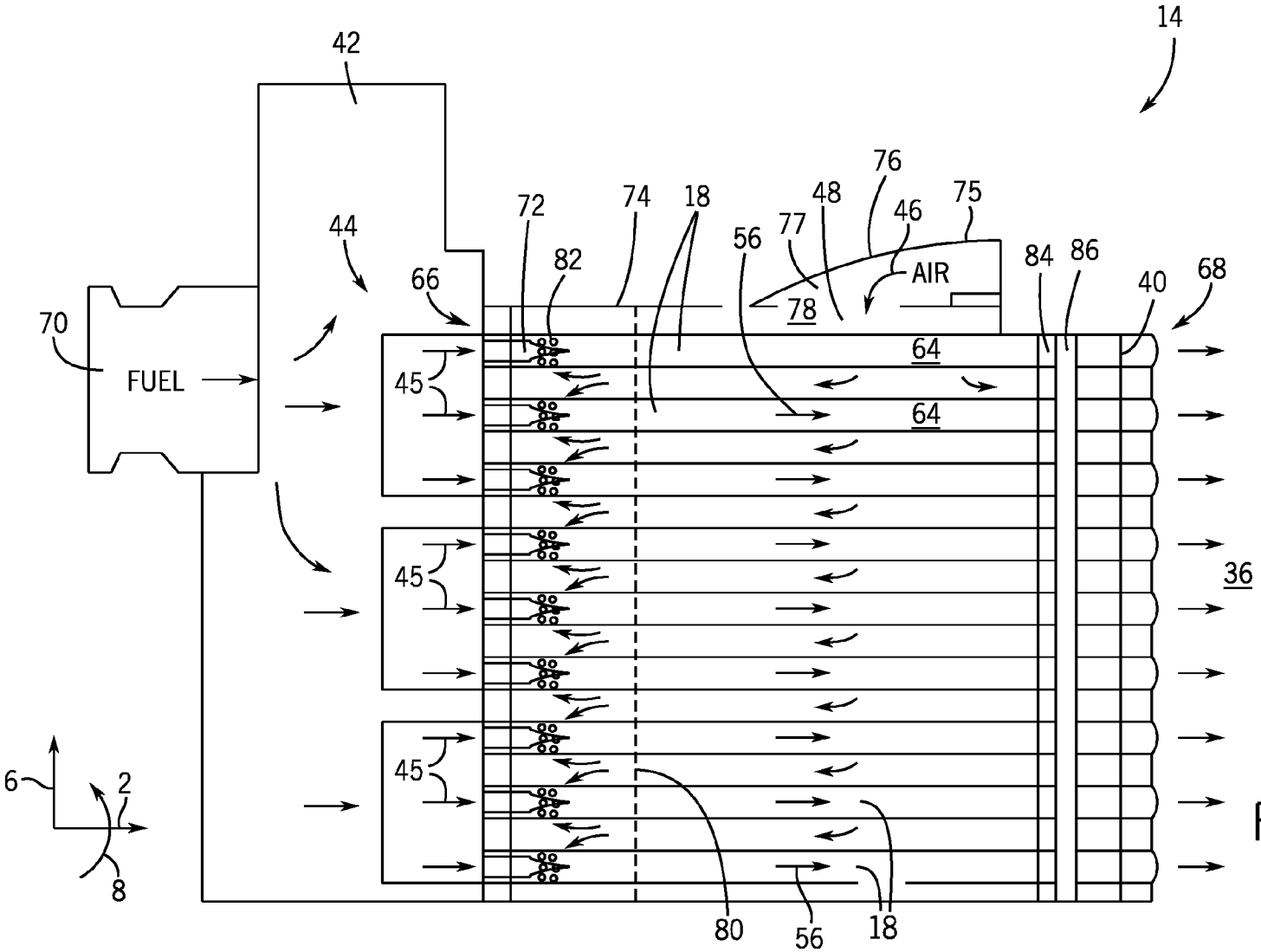
FIG. 3 is a cross-sectional side view schematic of an embodiment of the turbine combustor of FIG. 2, illustrating the plurality of mixing tubes.

FIG. 3 is a schematic illustration of the plurality of mixing tubes 18 within the combustor 14. As shown, each mixing tube 18 has a passage or chamber 64 extending between a first end 66 (e.g., axial end opening) and a second end 68 (e.g., axial end opening) of the mixing tube 18. In some embodiments, the second end 68 of the mixing tube 18 may extend through the cap 40 so that the fuel-air mixture may be output from the mixing tube 18 into the combustion chamber 36 through an axial end opening generally located at the second end 68 of the mixing tube 18.

In some embodiments, the end cover 42 may be positioned upstream of, and proximate to, the first end 66 of the mixing tube 18. The end cover 42 may include one or more fuel inlets 70 through which the fuel 20 is provided to one or more fuel plenums 44 (e.g., 1, 2, 3, 4, 5, 6, 7, 8, 9, 10, or more) within the end cover 42. Furthermore, each fuel plenum 44 may be fluidly connected to one or more fuel injectors 72 (e.g., 1, 2, 3, 4, 5, 6, 7, 8, 9, 10, or more). As illustrated, each mixing tube 18 includes a respective fuel injector 72, which receives the fuel 20 in the axial direction 2 as indicated by arrows 45. In some embodiments, the end cover 42 may include a single common fuel plenum 44 (e.g., fuel supply chamber) for all of the mixing tubes 18 and associated fuel injectors 72. In other embodiments, the system 10 may include one, two, three, or more fuel plenums 44 that each provides fuel 20 to a subgroup of fuel injectors 72, and ultimately to the mixing tube 18 associated with each fuel injector 72. For example, one fuel plenum 44 may provide fuel to about 5, 10, 50, 70, 100, 500, 1000, or more fuel injectors 72. In some embodiments, the combustor 14 having subgroups of fuel injectors 72 supplied by different fuel plenums 44 may allow one or more subgroups of fuel injectors 72 and corresponding mixing tubes 18 to be run richer or leaner than others, which in turn may allow for more control of the combustion process, for example. Additionally, multiple fuel plenums 44 may enable the use of multiple types of fuel 20 (e.g., at the same time) with the combustor 14.

As shown in FIG. 3, a support structure 74 (e.g., side wall) may circumferentially surround the head end 38 of the combustor 14, and the support structure 74 may generally protect and/or support the mixing tubes 18 and other structures within the head end 38. For example, the support structure 74 may be an outer annular wall. As described above, in some embodiments, pressurized air 22 may enter the head end 38 through an air inlet 48. More specifically, pressurized air 22 may flow through the air inlet 48 laterally into an air cavity 78 within the head end 38 (e.g., in a generally radial direction 6 as indicated by arrow 46). The air cavity 78 includes the volume of space within the head end 38 between the plurality of mixing tubes 18 and surrounded by the support structure 74 (e.g., outer wall). The pressurized air 22 spreads throughout the air cavity 78 as the pressurized air 22 flows to each of the plurality of mixing tubes 18. In some embodiments, a flow distributor diffuser 76 (e.g., a baffle, conduit, or turning vane) may be provided in the combustor 14 to improve distribution of the pressurized air 22 within the head end 38. The diffuser 76 may be an annular flow conditioning diffuser configured to distribute the pressurized air 22 forward, radially 6 inward, and/or externally across the plurality of mixing tubes 18. For example, the diffuser 76 may include a tapered annular wall 75, which gradually angles or curves inwardly toward the cavity 78 and mixing tubes 18 in the radial direction 6. The diffuser 76 also may include an annular internal passage 77, which generally diverges or grows in cross-sectional area toward the cavity 78 and the mixing tubes 18. In some embodiments, the diffuser 76 may diffuse the pressurized air 22, such that the pressurized air 22 is substantially evenly distributed to each mixing tube 18. Additionally or alternatively, a perforated air distribution plate 80, indicated by a dashed line in FIG. 3, may be provided within the cavity 78 of the head end 38, and the air distribution plate 80 may generally be positioned between the end cover 42 and the cap 40. The perforations in the air distribution plate 78 may be of any of a variety of shapes and sizes, and may generally provide additional diffusion and distribution of the pressurized air 22, so as to improve distribution of the pressurized air 22 to the mixing tubes 18. After entering the head end 38 through the air inlet 48, the pressurized air 22 may enter each mixing tube 18 through one or more apertures 82 formed in the mixing tubes 18.

As shown in FIG. 3, in some embodiments, the combustor 14 also has a retainer 84 and/or an impingement plate 86. The retainer 84 and/or the impingement plate 86 may be positioned downstream of the fuel injectors 72 and generally proximate to the cap 40. In some embodiments, the cap 40, the retainer 84, and/or the impingement plate 86 may be removable or separable from the support structure 74, for example. The retainer 84 and/or the impingement plate 86 may provide support for the mixing tubes 18. The impingement plate 86 may additionally or alternatively be configured to provide for cooling of the cap 40 within the combustor 14.

As discussed above and as shown in FIG. 3, one fuel injector 72 is provided for each mixing tube 18 of the combustor 14. In other words, one fuel injector 72 is positioned within a portion of each mixing tube 18 in order to deliver fuel 20 into the respective mixing tube 18. In some embodiments, the fuel injector 72 may be generally coaxially positioned within each mixing tube 18 by inserting the fuel injector 72 axially 2 through the first end 66 of each mixing tube 18. Thus, the mixing tube 18 may have a size, shape, and configuration that enable each mixing tube 18 to receive the corresponding fuel injector 72.

Figure 4:
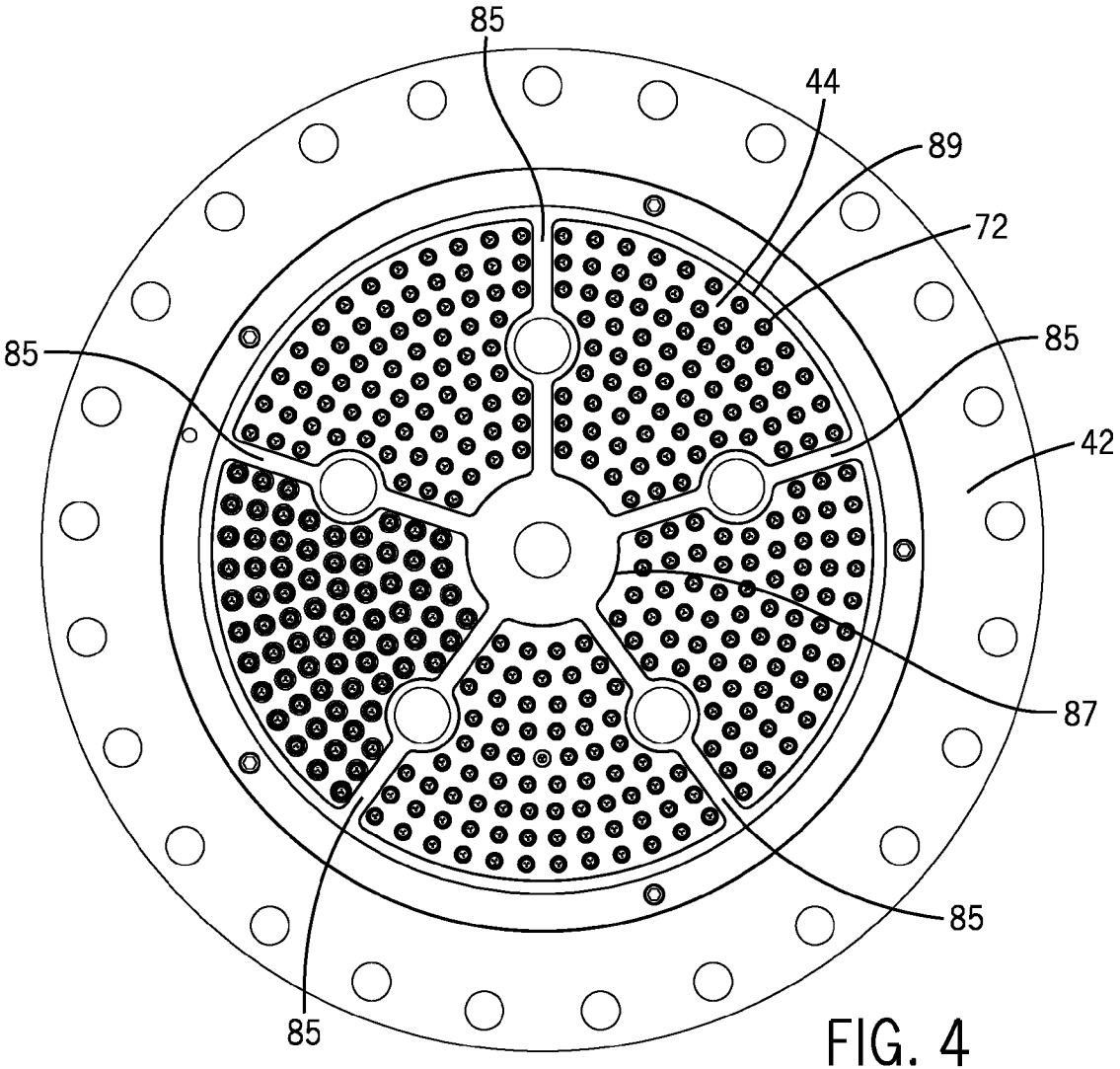
FIG. 4 is a perspective view of an embodiment of an end cover including a plurality of fuel injectors.

In certain embodiments, a plurality of fuel injectors 72 may be coupled to the end cover 42 of the combustor 14, as best illustrated in FIG. 4. Together, the end cover 42 and the fuel injectors 72 may be described as a fuel injector assembly or module. In some embodiments, the fuel injectors 72 may be removably coupled to the end cover 42. For example, the fuel injectors 72 may be brazed to the end cover 42 or the fuel injectors 72 may be threadably coupled to the end cover 42. In certain embodiments, the fuel injectors 72 may be threadably coupled and further sealed to the end cover 42. Generally, the fuel injectors 72 may be configured to be removed by machining or unthreading. While the fuel injectors 72 are coupled to the end cover 42 as a fuel injector assembly or module, the mixing tubes 18 may be supported within the support structure 74 as a mixing tube assembly or module. Thus, the fuel injector module and the mixing tube module enable quick and simple assembly of all mixing tubes 18 and associated fuel injectors 72 by assembling these two modules with one another.

FIG. 4 illustrates the end cover 42 having a plurality of fuel plenums 44. In certain embodiments, each fuel plenum 44 may be removably coupled to the end cover 42. For example, the fuel plenums 44 may be bolted to the end cover, and can therefore, be unbolted for inspection, removal, and/or replacement. Additionally, in some embodiments, the end cover 42 may have a plurality of fuel plenums 44, wherein each fuel plenum 44 supplies a subgroup of fuel injectors 72, as described above. Specifically, FIG. 4 illustrates an embodiment having five fuel plenums 44, wherein each fuel plenum 44 supplies a subgroup of fuel injectors. Each fuel plenum 44 may supply a subgroup of 5 to 500, 10 to 400, 20 to 300, 30 to 200, or 40 to 100 72 fuel injectors 72. As noted above, not only may the fuel injectors 72 be individually removed, but each of the fuel plenums 44 (and its associated subgroup of fuel injectors 72) may also be detached and removed from the end cover 42. As a result, the described embodiment provides multiple options for fuel injector 72 removal, inspection, repair, and/or replacement. Each fuel plenum 44 may be circular, triangular, rectangular, or generally polygonal. In the illustrated embodiment, each fuel plenum 44 has a sector shape or truncated pie shape, which may be surrounded by converging radial walls 85, an inner curved wall 87, and an outer curved wall 89.

Figure 5:
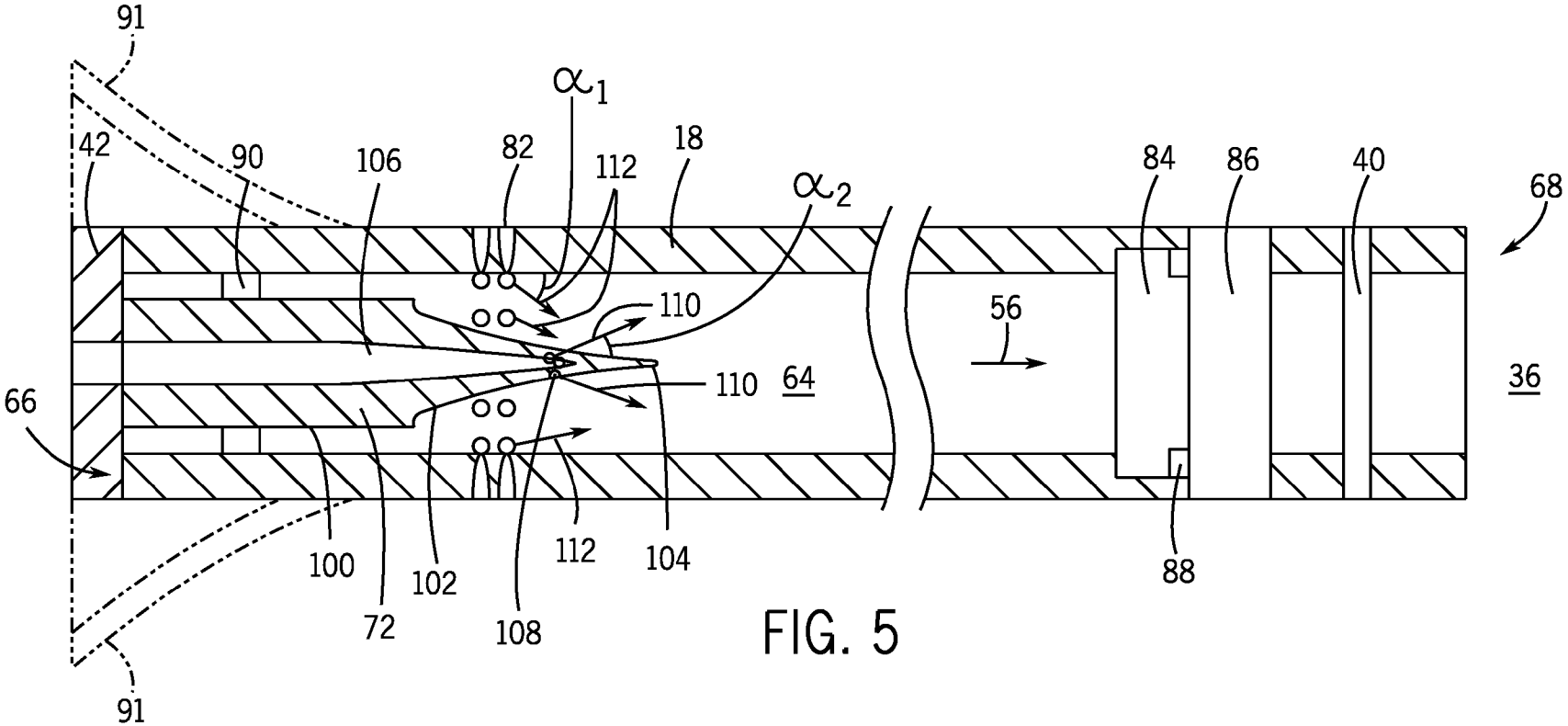
FIG. 5 is a cross-sectional side view schematic of an embodiment of one mixing tube including a fuel injector.

Turning to FIG. 5, an embodiment of one mixing tube 18 having the fuel injector 72 positioned therein is illustrated. As described above, the mixing tube 18 may have one chamber 64 (e.g., passage) extending between the first end 66 and the second end 68 of the mixing tube 18. In some embodiments, the mixing tube 18 may extend generally between the end cover 42 and the cap 40, and may further extend through the cap 40 into the adjacent combustion chamber 36, so that the fuel-air mixture may be delivered into the combustion chamber 36. In certain embodiments, the mixing tube 18 may be attached to the cap 40 and/or the end cover 42 via a braze, weld, threads, brackets, clamps, or interference fits. However, in some embodiments, the mixing tube 18 is not fixedly attached to the end cover 42 or the cap 40. Furthermore, the mixing tube 18 may not be permanently attached to any components within the combustor 14. Rather, the mixing tube 18 may be floating or suspended within the head end 38, e.g., supported by one or more structures within the combustor 14. In some embodiments, the mixing tube 18 may be supported by one or more of the cap 40, the retainer 84, the impingement plate 86, various springs, or other supporting structures, or any combination thereof. For example, a spring 88 may be provided to support the mixing tube 18. In the illustrated embodiment, the spring 88 is positioned between the retainer 84 and the impingement plate 86, and the spring 88 may generally provide axial constraint to the mixing tube 18, while also enabling axial movement in response to movement, vibration, thermal expansion or contraction, or any combination thereof.

For example, such floating configurations may enable accommodation of thermal growth of the mixing tube 18 and other components of the combustor 14. In operation, the heat generated within the combustor 14 may result in thermal growth of the mixing tube 18 as well as support structures, such as the retainer 84 or impingement plate 86. If the mixing tube 18 is floating, such that it is supported, but unattached, to the nearby structures such as the retainer 84 and impingement plate 86, then thermal growth may be more easily tolerated. Thus, in such configurations, degradation of the components and/or reduced shearing forces between the components, for example, may be reduced.

Each mixing tube 18 within the combustor 14 may further have any of a variety of shapes and sizes. In some embodiments, each mixing tube 18 may have a generally cylindrical shape, and may have a generally circular cross-section, for example. Additionally, in some embodiments, the mixing tube 18 may have a diameter from approximately 0.5 centimeters to approximately 3 centimeters, or more. In other embodiments, the mixing tube 18 may have a diameter of approximately 0.5 to 2, 0.75 to 1.75, or 1 to 1.5 centimeters. In certain embodiments, the mixing tube 18 may have a diameter of approximately 0.75 centimeters. It should be understood that all mixing tubes 18 within the combustor 14 may have a substantially similar diameter, but that in certain embodiments the mixing tubes 18 may have different diameters. Furthermore, each mixing tube 18 may have a length of from approximately 1 centimeter to approximately 75 centimeters, in some embodiments. In certain embodiments, the mixing tubes may have a length of approximately 10 to 60, 15 to 50, 20 to 40, or 30 to 35 centimeters. In certain embodiments, the mixing tubes 18 within the combustor 14 may have substantially similar lengths, although in some embodiments the mixing tubes 18 may have two or more different lengths.

As discussed above, after entering the head end 38 through the air inlet 48, the pressurized air 22 may enter each mixing tube 18 through one or more apertures 82 formed in the mixing tubes 18. The apertures 82 may be configured to have any of a variety of shapes, sizes, and arrangements. For example, the apertures 82 may be generally circular, elliptical, or rectangular in cross-sectional shape. The apertures 82 may further have a diameter or a dimension in the range of from approximately 0.001 centimeters to approximately 1.5 or more centimeters. The apertures 82 may also have a diameter or dimension in the range of from approximately 0.01 to 1, 0.05 to 0.5, or 0.1 to 0.25 centimeters, for example. In some embodiments, one or more rows of apertures 82 may be spaced (e.g., evenly) around the circumference of the mixing tube 18. Furthermore, the apertures 82 may be positioned at an angle with respect to the mixing tube 18. In other words, the apertures 82 may be configured such that of the pressurized air 22 passes through the apertures 82 and flows into the chamber 64 of the mixing tube 18 at an angle $\alpha_1$ with respect to the wall of the mixing tube 18. In certain embodiments, the angle $\alpha_1$ at which the pressurized air 22 flows into the chamber 64 may be equal to, greater than, or less than 90 degrees. For example, the angle $\alpha_1$ may be approximately 10, 20, 30, 40, 50, 60, 70, or 80 degrees. The apertures 82 formed in the mixing tubes 18 may have substantially similar shapes, sizes, and/or angles, while in some embodiments the apertures 82 may have different shapes, sizes, and/or angles. In general, the apertures 82 may be positioned at any location along the mixing tube 18. However, in certain embodiments, the apertures 82 may be positioned upstream from the position at which the fuel 20 enters the mixing tube 18 through the fuel injector 72. Furthermore, the apertures 82 may be spaced circumferentially around the fuel injector 72, thereby directing the air radially inward toward the fuel injector 72.

Alternatively, rather than apertures 82, one or more of the mixing tubes 18 may have an expanded diameter at the first end 66 of the mixing tube 18 to allow pressurized air 22 to pass from the air cavity 78 into the mixing tube 18. In other words, the first end 66 may be expanded so as to have a bell-like shape 91. In such configurations, the pressurized air 22 may enter the mixing tube 18 through the expanded first end 66 of the mixing tube 18. For example, the pressurized air 22 may be distributed through the air inlet 48 axially and/or radially inwardly into the air cavity 78 and across the mixing tube 18 and towards the end plate 42. Then, the pressurized air 22 may enter the mixing tube 18 through the expanded first end 66 of the mixing tube 18. In some embodiments, one or more mixing tubes 18 within the combustor 14 may be configured to receive pressurized air 22 through the first end 66 of the mixing tube 18, while one or more mixing tubes 18 may be configured to receive the pressurized air 22 through apertures 82 formed on the wall of the mixing tube 18.

The fuel injector 72 is configured to be positioned within the mixing tube 18. As described above, the fuel injector 72 may be removably coupled to the end cover 42. Furthermore, the fuel injector 72 may generally extend from a shoulder 100 (e.g., first tubular portion) to an end portion 102 (e.g., second tubular portion). In certain embodiments, the shoulder 100 may have a larger diameter than the end portion 102, and the end portion 102 may be tapered (e.g., a tapered annular shape, such as a conical shape) such that the diameter gradually decreases from the shoulder 100 to a distal end 104 of the end portion 102. In certain embodiments, the end portion 102 may form a spike, or generally come to a point at the distal end 104, as shown in FIG. 5. Other shapes and configurations of the end portion 102 of the fuel injector 72 are envisioned, such as, an end portion 102 having a cylindrical shape, rectangular shape, or a hexagonal shape, for example. Additionally, the fuel injectors 72 may be configured to have any of a variety of suitable lengths, and may further have various shoulder 100 lengths and end portion 102 lengths. For example, in some embodiments, each fuel injector 72 may have a length of from approximately 0.1 centimeters to approximately 25, or more, centimeters. In some embodiments, the fuel injector 72 may have a length of approximately 2 to 15, 4 to 10, or 5 to 8 centimeters. Furthermore, in some embodiments, the fuel injectors 72 within the combustor 14 may have substantially similar lengths, although in other embodiments, the fuel injectors 72 may have two or more different lengths. Additionally, the ratio between a length of the shoulder 100 and a length of the end portion 102 for the fuel injector 72 may be approximately 1:1. Although, in other embodiments, the ratio may be approximately 2:1 or 1:2, 3:1 or 1:3, 4:1 or 1:4 or any other suitable ratio, for example. In some embodiments, a spring 90, such as a radial spring, may additionally be provided around a portion of the shoulder 100 of the fuel injector 72 to support the fuel injector 72.

As discussed above, fuel 20 may pass from the fuel plenum 44 located on or within the end cover 42 through a fuel inlet 105 into a fuel passage 106 within the fuel injector 72. The fuel 20 may exit the fuel passage 106 at one or more holes 108 (e.g., fuel outlets) positioned on the fuel injector 72. The holes 108 may be positioned at any suitable location on the fuel injector 72. For example, in some embodiments, the holes 108 may be positioned on the shoulder 100 of the fuel injector 72. In other embodiments, the holes 108 may be positioned on the end portion 102 of the fuel injector 72. Furthermore, the holes 108 may be positioned on any substantially cylindrical portion of the fuel injector 72, or on any substantially tapered or conical portion of the fuel injector 72.

Additionally, the holes 108 may be configured in any of a variety of ways, and more particularly, the holes 108 may have any of a variety of shapes, angles, and sizes. For example, in some embodiments, the holes 108 may have a substantially circular cross-sectional shape. In some embodiments, one or more of the holes 108 may configured so that the fuel 20 is injected into the chamber 64 of the mixing tube 18 at an angle $\alpha_2$ relative to the wall of the fuel injector 72. For example, the hole 108 may be configured so that the fuel 20 is injected into the chamber 64 at an angle $\alpha_2$ equal to, greater than, or less than approximately 90 degrees with respect to the wall of the fuel injector 72. In other embodiments, the hole 108 may be configured so that the fuel 20 is injected into the chamber 64 at an angle $\alpha_2$ of approximately 10, 20, 30, 40, 50, 60, 70, or 80 degrees with respect to the wall of the fuel injector 72. The holes 108 may be generally configured such that the flame holding characteristics of the combustor improve. Additionally, in some embodiments, the one or more holes 108 may be positioned circumferentially about the fuel injector 72. For example, the holes 108 may be spaced evenly around the circumference of the fuel injector 72. In certain embodiments, the holes 108 may be configured such that the fuel 20 may be radially discharged and spread radially outwardly as indicated by arrows 110 into the chamber 64 of the mixing tube 18. The holes 108 may be substantially the same size, although in other embodiments the holes 108 may have different sizes. In some embodiments having a plurality of holes 108 on each fuel injector 72, the plurality of holes 108 may be configured to have substantially similar sizes, shapes, and/or angles. Alternatively, the plurality of holes 108 may be configured to have one or more different sizes, shapes, and/or angles.

The combustor 14 of the present disclosure may operate in any of a variety of manners. In the embodiment illustrated in FIG. 5, for example, pressurized air 22 may enter the mixing tube 18 through one or more apertures 82, as described above. In certain embodiments, the apertures 82 may be formed upstream of the holes 108 that inject the fuel 20 into the mixing tube 18. In such embodiments, the pressurized air 22 passes into the chamber 64 of each mixing tube 18 and flows around the fuel injector 72 and generally downstream towards the combustion chamber 36 as indicated by arrow 110. The fuel 20 may be injected through holes 108 as shown by arrows 112 into the cross-flowing stream of pressurized air 22 shown by arrows 110. Additionally, as shown by arrow 112 and as described above, the fuel 20 may be injected into the chamber 64 at an angle $\alpha_2$, or, in other words, the fuel 20 may be injected outward from the fuel injector 72 and/or towards the combustion chamber 36. Regardless of the mechanisms and locations for injecting the pressurized air 22 and fuel 20 into the chamber 64 of the mixing tube 18, the fuel 20 may be mixed with the pressurized air 22 within the chamber 64 as the constituents flow through the mixing tube 18 towards the combustion chamber 36, as indicated by arrow 56. The fuel-air mixture may expand as the fuel-air mixture exits the mixing tube 18 at the second end 68 of the mixing tube 18, and the fuel-air mixture may burn inside the combustion chamber 36.

Although some typical sizes and dimensions have been provided above in the present disclosure, it should be understood that the various components of the described combustor may be scaled up or down, as well as individually adjusted for various types of combustors and various applications. Additionally, it should be understood that a variety of other suitable components may be incorporated into the gas turbine system 10 described herein. For example, one or more of swirl nozzles to aid in mixing the fuel and air, liquid fuel atomizing injectors, igniters, or sensors that are in communication with the combustion chamber 36 and the end cover 42, may be incorporated into any of the described embodiments.

Figure 6:
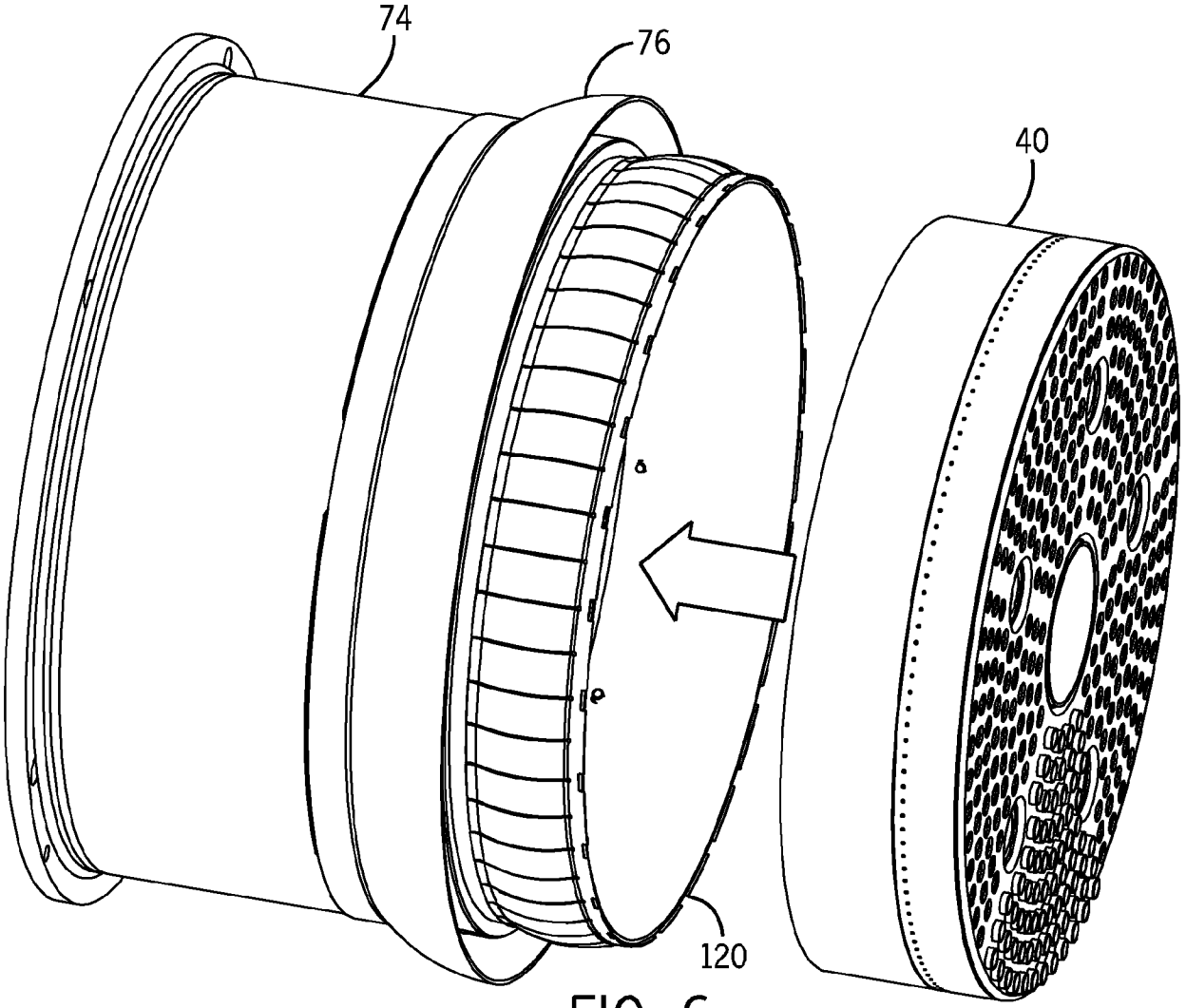
FIG. 6 is a perspective view of an embodiment of a portion of the turbine combustor, illustrating a step in an assembly process of the gas turbine system.
Figure 8:
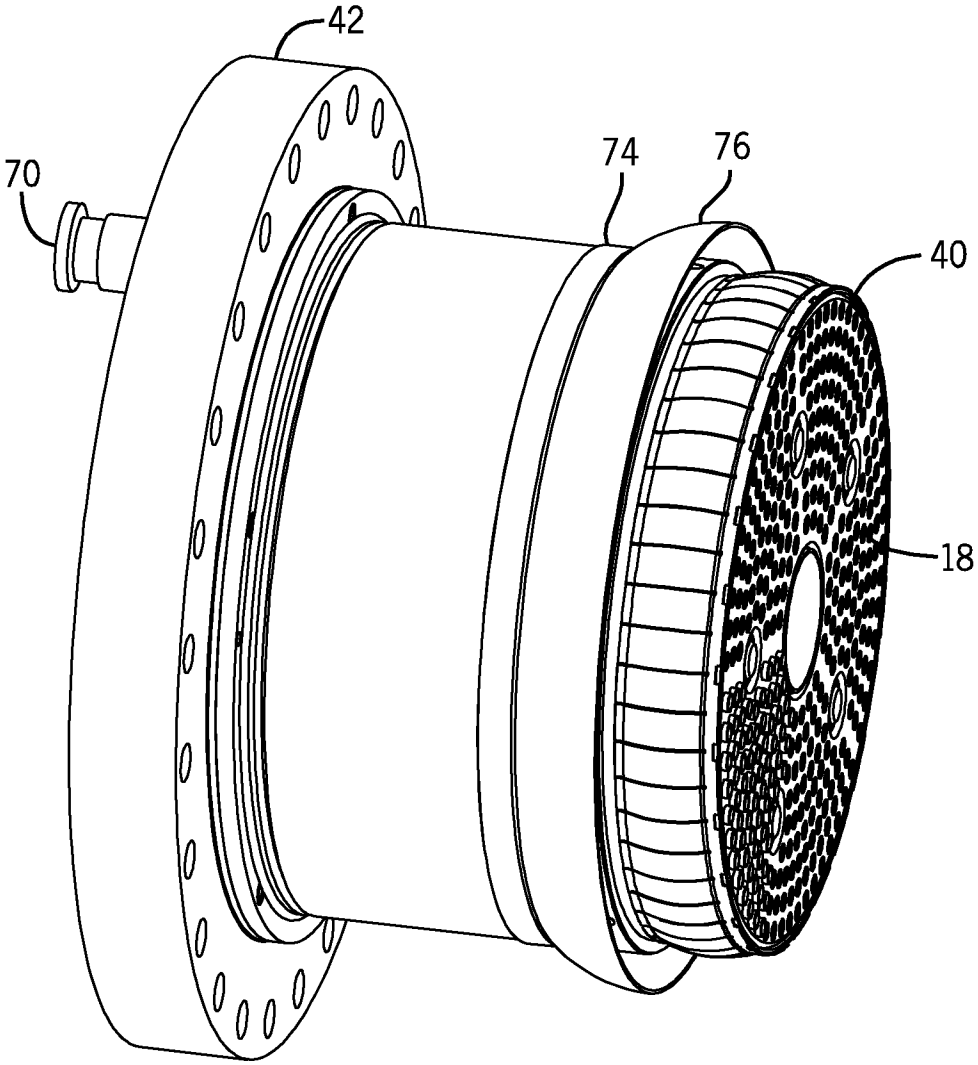
FIG. 8 is a perspective view of an embodiment of a portion of the turbine combustor, illustrating a step in an assembly process of the gas turbine system.
Figure 9:
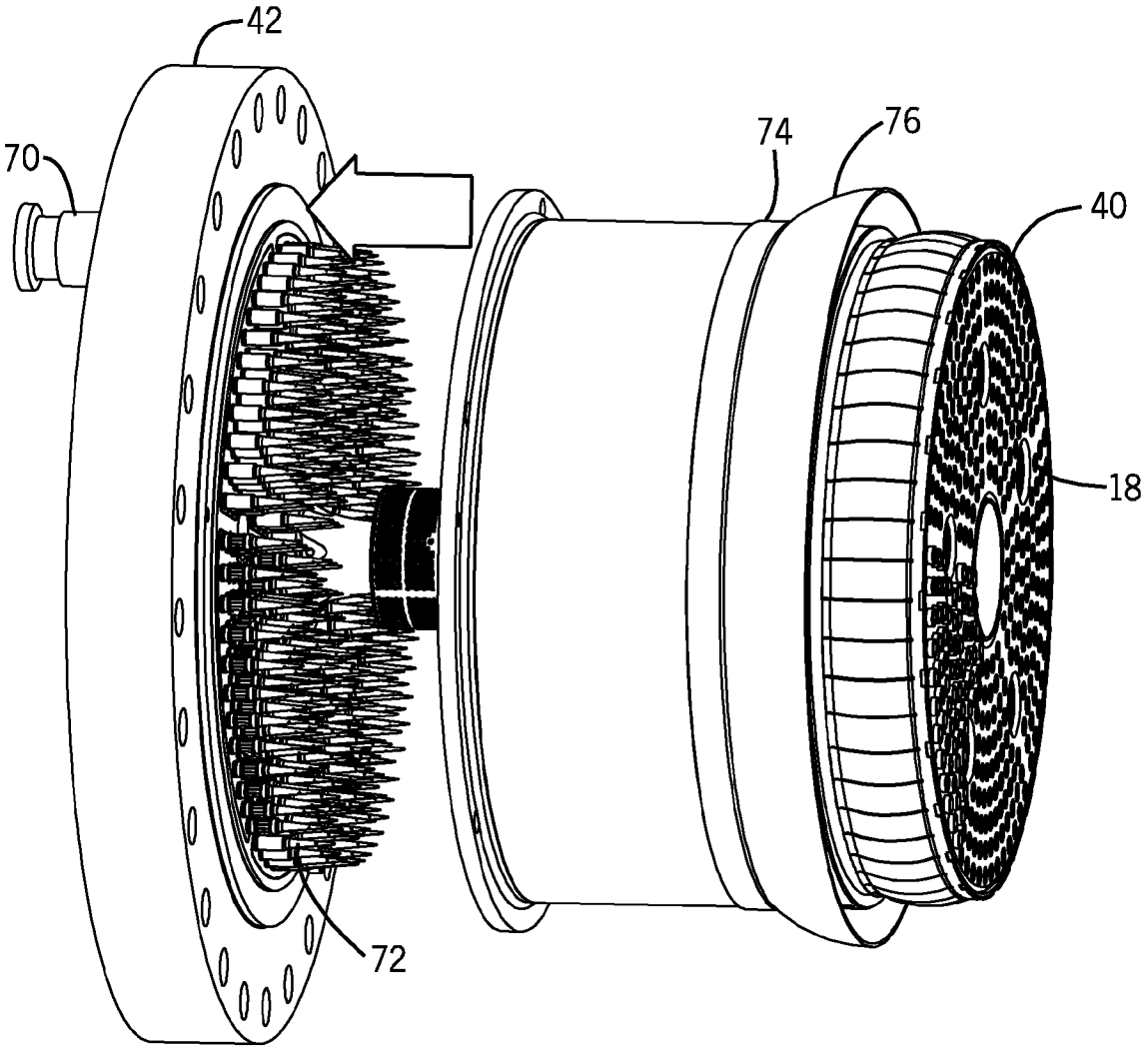
FIG. 9 is a perspective view of an embodiment of a portion of the turbine combustor, illustrating a step in an assembly process of the gas turbine system.

FIGS. 6-9 illustrate one manner in which various components of the gas turbine system 10 may be assembled, arranged, and/or coupled together, in accordance with the present disclosure. As shown in FIG. 6, the removable cap 40 may be inserted into a distal end 120 of the support structure 74. As shown in FIG. 7, a plurality of the mixing tubes 18 may be assembled and positioned within the support structure 74, upstream of the cap 40 (e.g., perforated cap). The cap 40 may include a plurality of openings or receptacles 118, which receive and support the mixing tubes 18. One or more additional supports, such as the illustrated retainer 84 (e.g., perforated retainer plate), may be positioned around the mixing tubes 18. For example, the illustrated retainer 84 includes a plurality of openings or receptacles 120, which receive and support the fuel injectors 72 and/or mixing tubes 18. As noted above, the impingement plate 86 and/or springs may also be utilized to support the mixing tubes 18 within the support structure 74. As shown in FIG. 8, the support structure 74 having the mixing tubes 18 positioned therein may be coupled to the end plate 42. More specifically, and as illustrated, the plurality of fuel injectors 72 may be removably attached to the end plate 42 such that when the support structure 74 and end plate 42 are coupled together, each fuel injector 72 may be inserted into its corresponding mixing tube 18. In other words, once the support structure 74 and end plate 42 are coupled, each mixing tube 18 has one fuel injector 72 positioned coaxially therein. FIG. 9 illustrates one embodiment of a portion of the combustor 14 in accordance with the present disclosure. As illustrated, the fuel inlet 70 may be coupled to the end plate 42. The mixing tubes 18 are shown passing through the cap 40, so that the fuel-air mixture can be deposited from the mixing tubes into the combustion chamber 36 located downstream of the cap 40.

As described above, a gas turbine engine system includes components for premixing fuel and air prior to combustion within a combustion chamber. The disclosed embodiments are generally directed towards a fuel and air premixing system having a plurality of mixing tubes (e.g., 10 to 1000 mixing tubes), wherein each mixing tube is paired with a fuel injector. In certain embodiments, the fuel injector injects fuel axially and/or radially into the mixing tube, while pressurized air is transferred radially into the mixing tube. The fuel and air then mix in a chamber within the mixing tube, and the fuel-air mixture is deposited into a combustion chamber for combustion.

The embodiments described herein may provide a variety of advantages for a combustion system. For example, the parts may be relatively low cost, easy to manufacture, and refurbish. Moreover, many of the parts can be easily accessed and/or removed for evaluation, replacement and/or repair, without requiring disassembly of the entire combustor. For example, individual fuel injectors, mixing tubes, and/or fuel plenums can be accessed or removed. Furthermore, fuel and/or pressurized air may be distributed more uniformly across the plurality of mixing tubes, resulting in more efficient combustions. The premixing actions may be more effective such that the premixing components may be smaller and shorter, allowing for a smaller and shorter premixing space, as well as less material and cost in manufacturing. Finally, the configurations described herein may advantageously provide for increased flame holding margin, particularly for high hydrogen content. Of course, the benefits listed above are only a few of the benefits that may be expected in some combustors configured in accordance with the present disclosure.

The invention claimed is:

1. A premixing system for a gas turbine engine, the premixing system comprising:

a plurality of mixing tubes, each of the plurality of mixing tubes comprising:

a wall defining a chamber within each of the plurality of mixing tubes, wherein the chamber extends between a first end and a second end of each of the plurality of mixing tubes;

one or more apertures formed in the wall of each of the plurality of mixing tubes, wherein the one or more apertures are configured to receive an air flow;

a fuel intake portion configured to receive a fuel flow from one or more holes formed in a wall of a fuel injector positioned axially within the first end of each of the plurality of mixing tubes, wherein each of the one or more apertures is positioned upstream of each of the one or more holes formed in the wall of the fuel injector; and a fuel-air mixture outlet positioned at the second end of each of the plurality of mixing tubes to enable a fuel-air mixture to flow into a combustion chamber of a combustor;

wherein each of the plurality of mixing tubes extends between an end cover and a cap of the combustor, each of the plurality of mixing tubes extends through the cap into the combustion chamber, and each of the plurality of mixing tubes is not fixedly attached to the end cover and is not fixedly attached to the cap;

wherein the premixing system comprises a plurality of the fuel injector, each of the plurality of fuel injectors is axially positioned within a respective mixing tube of the plurality of mixing tubes, and each of the plurality of fuel injectors is coupled to the end cover.

2. The system of claim 1, wherein each of the plurality of mixing tubes is supported by the cap, a retainer, an impingement plate, or a spring.

3. The system of claim 1, comprising a diffuser configured to distribute air from an annulus between a flow sleeve and a liner of the combustor to the one or more apertures positioned on the wall of each of the plurality of mixing tubes.

4. The system of claim 1, wherein each of the plurality of the fuel injectors comprises a substantially cylindrical shoulder portion and a tapered distal portion, and each hole of the one or more holes is disposed in the tapered distal portion of each of the plurality of the fuel injectors.

5. The system of claim 1, wherein the plurality of fuel injectors are in fluid communication with a fuel plenum-configured to supply fuel to the plurality of fuel injectors.

6. The system of claim 1, wherein each of the plurality of mixing tubes comprises a diameter between approximately 0.5 to 2 centimeters.

7. The system of claim 1, wherein each of the plurality of mixing tubes is supported by a retainer, an impingement plate, and a spring, wherein the retainer, the impingement plate, and the spring are each positioned downstream of the fuel injector between the fuel injector and the combustion chamber along an axial axis of the combustor, the spring is positioned between the retainer and the impingement plate along the axial axis of the combustor, wherein the spring is configured to provide axial constraint to each of the plurality of mixing tubes.

8. The system of claim 7, wherein the retainer comprises a perforated plate disposed about each mixing tube of the plurality of mixing tubes.

9. A gas turbine system, comprising:

a combustor, comprising:

a combustion chamber;

an end cover;

a perforated cap comprising a plurality of openings and positioned downstream of the end cover;

a plurality of mixing tubes, each of the plurality of mixing tubes configured to receive fuel and air and deposit a fuel-air mixture into the combustion chamber, wherein the air is received radially into a mixing chamber of each of the plurality of mixing tubes through a plurality of apertures formed in each of the plurality of mixing tubes, each of the plurality of mixing tubes extends between the end cover and the perforated cap, each of the plurality of mixing tubes is supported within a respective opening of the plurality of openings of the perforated cap, each of the plurality of mixing tubes is not fixedly attached to the end cover and is not fixedly attached to the perforated cap, and each of the plurality of mixing tubes is supported by the perforated cap and extends through the perforated cap into the combustion chamber; and a plurality of fuel injectors, wherein each of the plurality of fuel injectors is coupled to a respective mixing tube of the plurality of mixing tubes, each of the plurality of fuel injectors is axially positioned within the respective mixing tube of the plurality of mixing tubes, and wherein each of the plurality of fuel injectors is configured to inject fuel axially and/or radially through a plurality of holes formed in a wall of each of the plurality of fuel injectors into the mixing chamber of the respective mixing tube of the plurality of mixing tubes, wherein each of the plurality of apertures is positioned upstream of each of the plurality of holes, and each of the plurality of fuel injectors is coupled to the end cover.

10. The system of claim 9, comprising a diffuser configured to distribute air from an annulus between a flow sleeve and a liner of the combustor to the plurality of apertures formed in each of the plurality of mixing tubes.

11. The system of claim 9, wherein each of the plurality of fuel injectors comprises a cylindrical shoulder portion and a tapered distal portion, and wherein the plurality of holes is disposed in the tapered distal portion of each of the plurality of fuel injectors.

12. The system of claim 9, comprising a plurality of fuel plenums, wherein each of the plurality of fuel plenums is configured to supply fuel to at least some of the plurality of fuel injectors.

13. The system of claim 9, where each of the plurality of mixing tubes comprises a diameter between approximately 0.5 to 2 centimeters.

14. The system of claim 9, wherein each of the plurality of mixing tubes is supported by a retainer, an impingement plate, and a spring, wherein the retainer, the impingement plate, and the spring are each positioned downstream of the fuel injector between the fuel injector and the combustion chamber along an axial axis of the combustor, the spring is positioned between the retainer and the impingement plate along the axial axis of the combustor, wherein the spring is configured to provide axial constraint to each of the plurality of mixing tubes.

15. The system of claim 14, wherein the retainer comprises a perforated plate comprising a plurality of openings configured to receive and support the plurality of mixing tubes.

16. The system of claim 9, wherein each of the plurality of fuel injectors comprises a first end configured to be coupled to the end cover and a second end positioned in the respective mixing tube of the plurality of mixing tubes, wherein each the plurality of apertures is positioned upstream of the second end of each of the plurality of fuel injectors and each of the plurality of mixing tubes includes a portion extending from the second end of the respective fuel injector of the plurality of fuel injectors to the perforated cap, and the portion is devoid of the plurality of apertures.

17. A method, comprising:

injecting fuel into a mixing chamber of a mixing tube through a plurality of holes in a wall of a fuel injector, wherein the fuel injector is axially positioned within an upstream portion of the mixing tube;

flowing air from an air cavity in a head end portion of a turbine combustor into the mixing chamber of the mixing tube through one or more apertures in a wall of the mixing tube into a flow of the fuel injected by the fuel injector, wherein the air flows through each aperture of the one or more apertures into the mixing chamber of the mixing tube upstream of the fuel injected through each hole of the plurality of holes;

supporting the mixing tube with a retainer, an impingement plate, and a spring, wherein the retainer, the impingement plate, and the spring are each positioned downstream of the fuel injector between the fuel injector and a combustion chamber of the turbine combustor along an axial axis of the turbine combustor, the spring is positioned between the retainer and the impingement plate along the axial axis of the turbine combustor, the spring is configured to provide axial constraint to the mixing tube, the mixing tube extends between an end cover and a cap of the combustor, the mixing tube extends through the cap into the combustion chamber, and the mixing tube is not fixedly attached to the end cover and is not fixedly attached to the cap mixing the air and fuel within the mixing chamber of the mixing tube to create a fuel-air mixture; and depositing the fuel-air mixture from the mixing chamber into the combustion chamber of the turbine combustor.

18. The method of claim 17, comprising flowing the air into the air cavity from an annulus formed between a flow sleeve and a liner of the turbine combustor.

19. The method of claim 18, comprising diffusing the air as the air flows from the annulus into the air cavity with an air diffuser positioned at the head end portion of the turbine combustor between the annulus and the air cavity.

* * * * *